US006389641B1

(12) United States Patent
Boomgaarden et al.

(10) Patent No.: US 6,389,641 B1
(45) **Date of Patent: *May 21, 2002**

(54) DUAL MODE DEBRIS PICKUP MACHINE

(75) Inventors: Steven L. Boomgaarden, Rosemount; Michael L. Blehert, Crystal; Gregory J. Engel, Plymouth, all of MN (US)

(73) Assignee: Tennant Company, Minneapolis, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/094,756

(22) Filed: Jun. 15, 1998

(51) Int. Cl.[7] ..... A47L 9/00
(52) U.S. Cl. ..... 15/340.1; 15/354
(58) Field of Search ..... 15/340.1, 354, 15/361, 329, 331, 334, 335

(56) References Cited

U.S. PATENT DOCUMENTS

| | | | | | |
|---|---|---|---|---|---|
| 514,678 | A | * | 2/1894 | Furnas | 15/340.1 |
| 2,867,833 | A | | 1/1959 | Duff | 15/323 |
| 2,878,508 | A | * | 3/1959 | Sedgwick et al. | 15/354 |
| 3,110,922 | A | | 11/1963 | Senne | 15/327.1 |
| 3,243,834 | A | * | 4/1966 | Trapp | 15/340.1 |
| 3,261,107 | A | | 7/1966 | Ponczek et al. | 15/315 |
| 3,474,483 | A | * | 10/1969 | Heidland | 15/340.1 |
| 3,710,412 | A | * | 1/1973 | Hollowell | 15/353 |
| 3,739,421 | A | | 6/1973 | Fukuba | 15/319 |
| 3,995,754 | A | * | 12/1976 | DeKonig | 15/340.1 |
| 4,050,113 | A | | 9/1977 | Wright et al. | 15/315 |
| 4,366,594 | A | | 1/1983 | Hyams | 15/314 |
| 4,578,840 | A | * | 4/1986 | Pausch | 15/340.1 |
| 4,688,292 | A | | 8/1987 | Schmiegel | 15/315 |
| 4,868,948 | A | * | 9/1989 | Arnold | 15/340.1 |
| 5,058,235 | A | * | 10/1991 | Charky | 15/354 |
| 5,138,742 | A | | 8/1992 | Charky | 15/340.1 |
| 5,519,915 | A | * | 5/1996 | Hollowell | 15/354 |
| 5,596,788 | A | * | 1/1997 | Linville et al. | 15/352 |
| 5,797,162 | A | | 8/1998 | Vystrcil et al. | 15/323 |
| 6,070,290 | A | * | 6/2000 | Schwarze et al. | 15/340.1 |

FOREIGN PATENT DOCUMENTS

| | | |
|---|---|---|
| FR | 2 424 426 A1 | 4/1979 |
| FR | 2 555 555 A1 | 5/1985 |
| FR | 2 605 907 A1 | 5/1988 |
| FR | 2 655 071 A1 | 5/1991 |
| FR | 2 667 086 A1 | 3/1992 |

* cited by examiner

*Primary Examiner*—Jill Warden
*Assistant Examiner*—Theresa T. Snider
(74) *Attorney, Agent, or Firm*—John F. Klos; Larkin, Hoffman, Daly & Lindgren, Ltd.

(57) ABSTRACT

A vacuum trash collection vehicle includes a debris container and a source of vacuum on the vehicle. There is a hose connected at one end to the debris container and has the source of vacuum applied thereto. The hose is open at its other end to form a debris collection nozzle. There is a boom for supporting the hose during use as a debris collection device. A vacuum pickup head is carried by the vehicle and there are operator controls for raising and lowering the pickup head. The pickup head has an opening of a size and shape to be connected to the hose nozzle. There is a driver accessible control for moving the hose and boom to utilize the hose nozzle as a debris collection device. The hose may be connected to the pickup head opening and thereby provide vacuum to the pickup head so that it functions as a debris collection device.

26 Claims, 10 Drawing Sheets

Fig. 14.
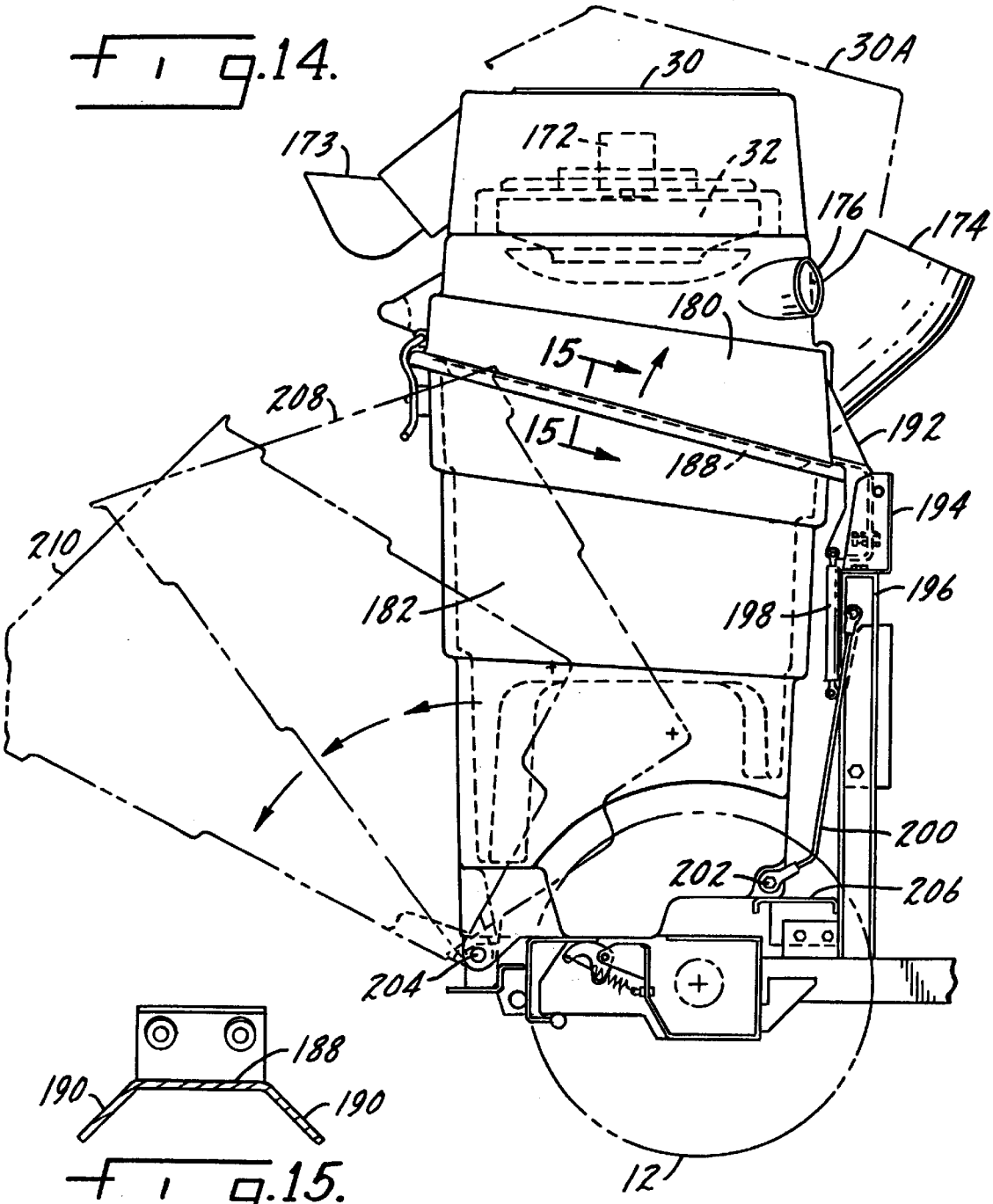
Fig. 15.
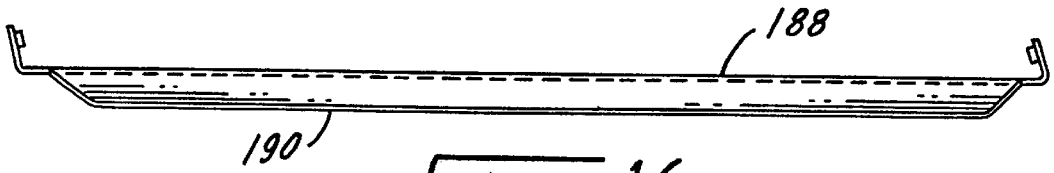
Fig. 16.

Fig. 18.
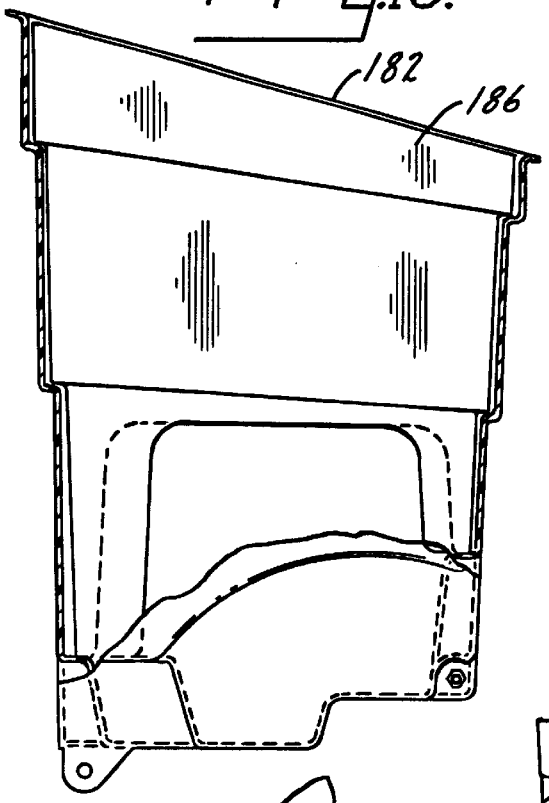
Fig. 20.
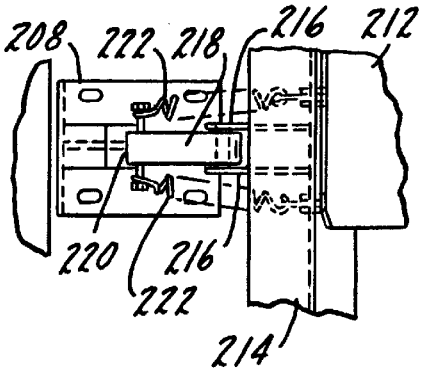
Fig. 19.
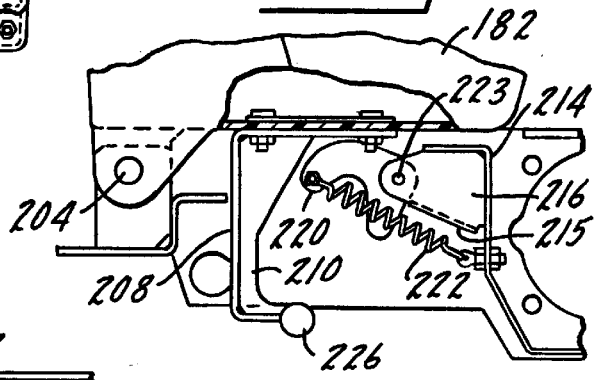
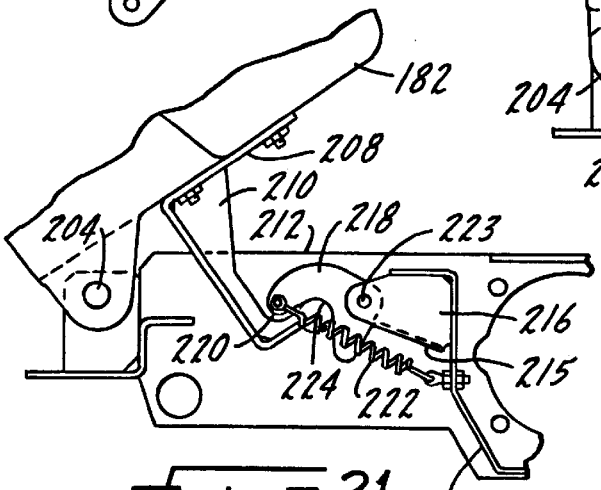
Fig. 21.
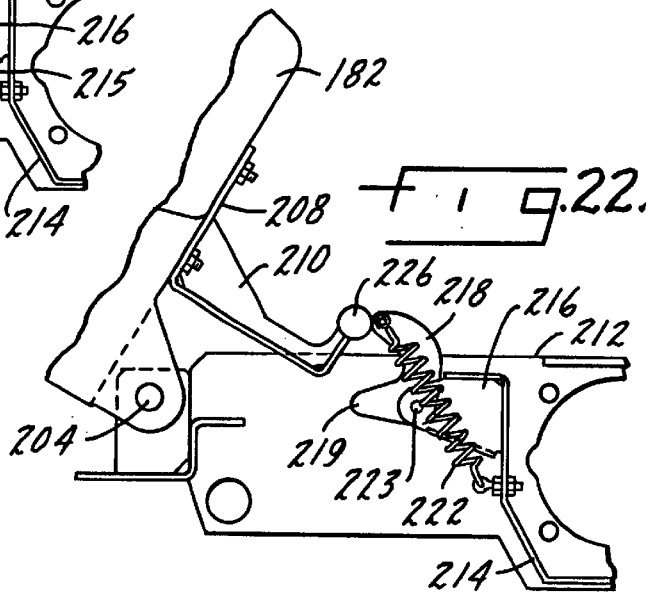
Fig. 22.

DUAL MODE DEBRIS PICKUP MACHINE

THE FIELD OF THE INVENTION

The present invention relates to vacuum trash collection vehicles of the type using a boom supported hose which extends over the driver's head as a debris collection device. Such hoses may have a diameter of, for example, eight inches. The present invention is an improvement on such a vehicle by providing a pickup head mounted on the front of the vehicle as an alternate debris collection device. When the pickup head is to be used, the hose is connected to an opening thereon to provide its source of vacuum. The operator, who sits on the vehicle, has the option of using either the hose to pick up isolated or scattered debris or the pickup head to pick up debris which may be concentrated in a particular area.

U.S. Pat. Nos. 3,710,412, 5,058,235, 5,138,742 and 5,519,915 all show vehicles of the general type described in that they each show a driver operated vehicle having a boom supported hose for manipulation by the driver. However, none of such vehicles have a pickup head as an alternate means of debris collection. The present invention is thus a substantial improvement on the prior art by providing both a hose to pick up scattered debris and a pickup head to collect concentrated debris.

SUMMARY OF THE INVENTION

The present invention relates to vacuum trash collection vehicles and particularly such vehicles which utilize a large diameter flexible hose, boom supported, for driver manipulation to collect debris.

A primary purpose of the invention is a trash collection vehicle of the type described which utilizes a vehicle-mounted pickup head as an alternate debris collection device with the pickup head receiving its vacuum when the hose is connected thereto.

Another purpose of the invention is to provide a trash collection vehicle of the type described having alternate pickup devices for use by the operator.

Another purpose of the invention is to provide a vehicle as described in which the pickup head has the vacuum opening at one side thereof and has an opening in its peripheral skirt on the opposite side whereby air travels across the width of the pickup head to provide increased air velocity for debris pickup.

Other purposes will appear in the ensuing specification, drawings and claims.

BRIEF DESCRIPTION OF THE DRAWINGS

The invention is illustrated diagrammatically in the following drawings wherein:

FIG. 14 is a side view, on an enlarged scale, showing the debris canister and the mounting thereof on the vehicle frame;

FIG. 15 is a section along plane 15—15 of FIG. 14;

FIG. 16 is a side view of the deflector plate mounted in the debris collection plenum chamber;

FIG. 18 is a side view, in part section, of the debris canister;

FIG. 19 is an enlarged partial side view of the pivotal connection between the debris canister and the vehicle frame;

FIG. 20 is a top view of the connection of FIG. 19;

FIG. 21 is an enlarged side view, similar to FIG. 19, but showing the debris canister in a second position; and FIG. 22 is a side view, similar to FIGS. 19 and 21, but illustrating the debris canister in a third position.

DESCRIPTION OF THE PREFERRED EMBODIMENT

Figure 1:
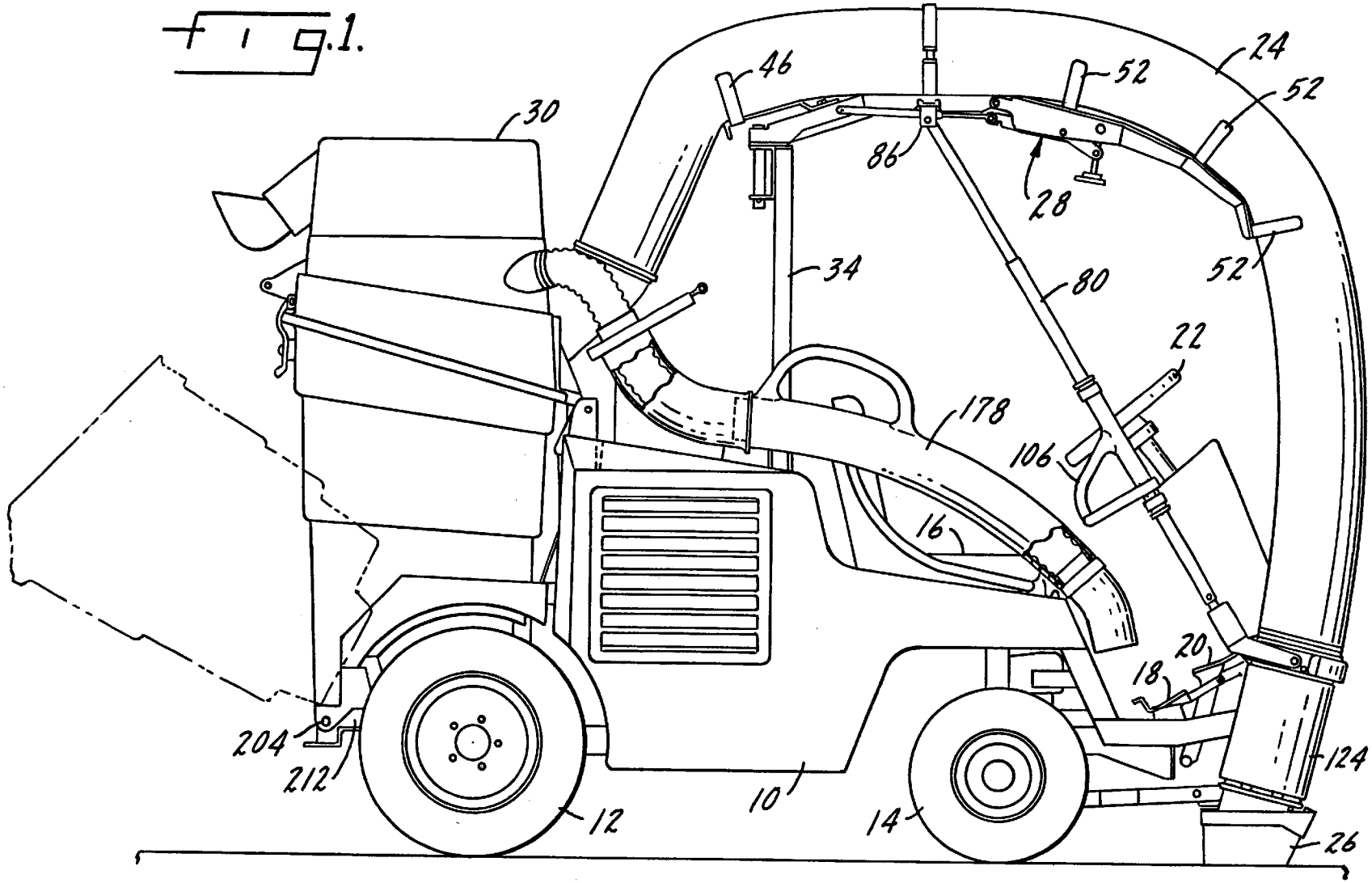
FIG. 1 is a side view of a trash collection vehicle of the type disclosed herein.

The litter collection vehicle of the present invention includes a body 10 mounted on rear wheels 12 and front wheels 14. The body may support a driver's seat 16 and there will be the typical controls for the driver to use in operating the vehicle. These may include foot pedals 18 and 20 and a steering wheel 22, as well as other conventional devices found on vehicles of this type.

The vehicle includes both a pickup hose with supporting control elements and what is described as a pickup head. The hose is indicated at 24 and the pickup head is indicated at 26. The hose may be supported by a counterbalance system indicated generally at 28 and, in the FIG. 1 position, provides the vacuum to the pickup head 26 by being mounted thereon. The opposite end of hose 24 is connected to a cover 30 within which is housed a vacuum fan 32 indicated in dotted lines in FIG. 14. Thus, suction will be applied to the end of the hose 24 connected to the vacuum fan, with the free end of the hose, when it is not mounted on the pickup head 26, being used by the operator to pick up litter.

Figures 2, 3, 4:
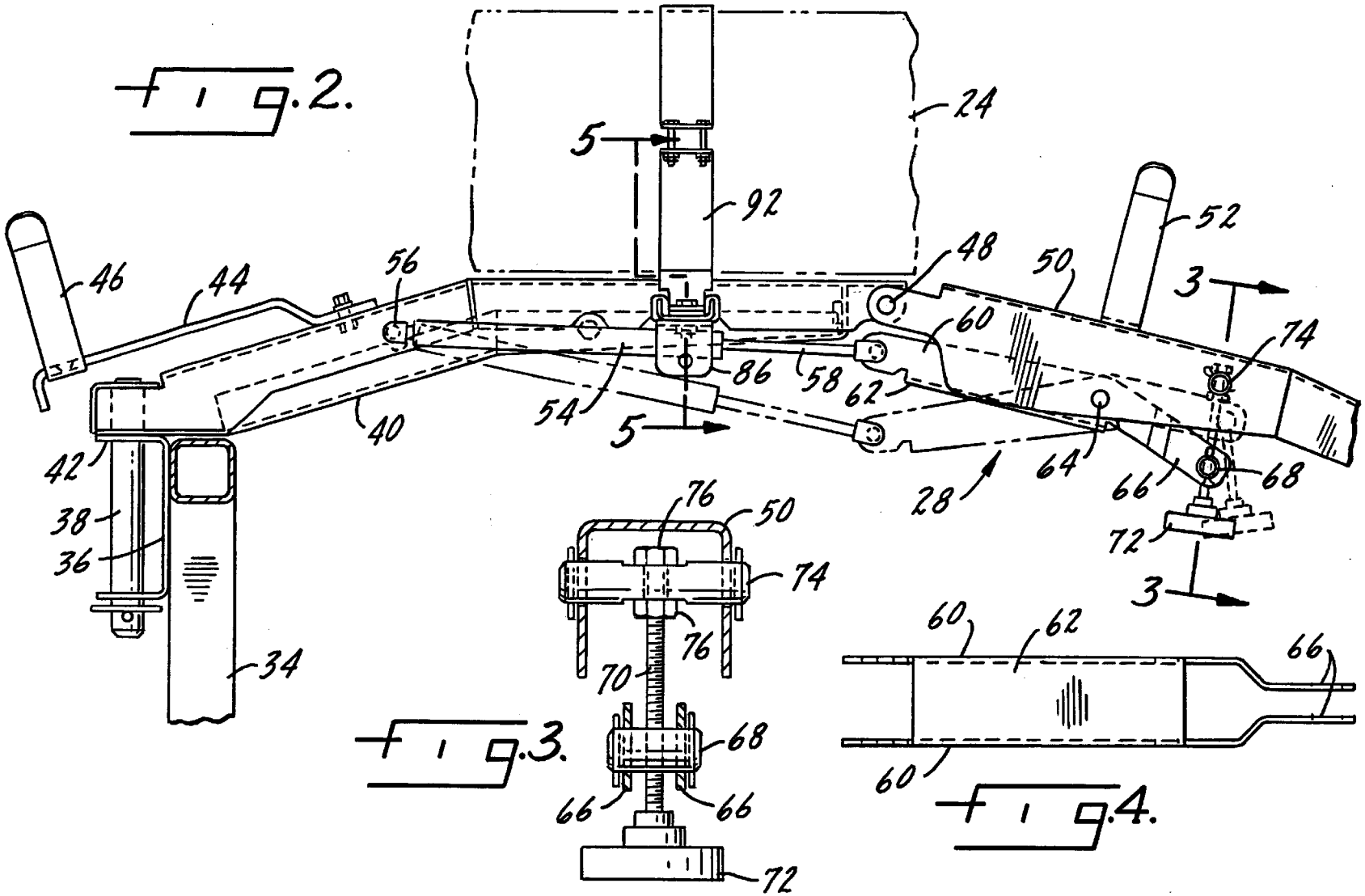
FIG. 2 is an enlarged partial side view of the support boom.
FIG. 3 is a section along plane 3—3 of FIG. 2.
FIG. 4 is a bottom view of the boom support lever.

The hose counterbalance support system 28 is detailed in FIGS. 2–4 and includes a U-shaped roll bar 34, the upper end of which mounts a generally U-shaped bracket 36. Bracket 36 pivotally mounts a rod 38 which in turn is attached to one end of a rear support arm 40. The support arm will be seated on the upper flange 42 of bracket 36 and will pivotally move to either side relative to roll bar 34 by means of the pivotal connection comprising rod 38 and bracket 36.

Rear support arm 40 carries a mounting bracket 44 which in turn mounts a hose support 46 which is one of several such hose supports used to hold the hose 24 up above the body 10, as shown in FIG. 1. Rear support arm 40 is pivotally connected, as at 48, to a front support arm 50 which mounts a series, in this case three, hose supports 52.

Pivotally mounted to rear support arm 40, as at 56, are a pair of spaced gas springs 54. Each of the springs 54 has a forwardly extending piston rod 58, with the two springs being pivotally mounted to opposite sides 60 of an intermediate lever 62 illustrated in side view in FIG. 2 and in bottom view in FIG. 4. As shown in FIGS. 2 and 4, the leftwardly-extending portions of the sides 60 will pivotally mount the two gas spring piston rods 58. It will be understood that the gas springs could alternatively be installed with their piston rods and cylinders in opposite locations. Lever 62 is pivotally mounted, as at 64, to the forward support arm 50 and its forward extensions 66 pivotally mount a pin 68 which threadedly mounts a screw 70, as particularly shown in FIG. 3. The screw 70 has a handle 72 which rotates the screw. The upper end of the screw is mounted loosely in a pin 74 by a pair of lock nuts 76, with the pin 74 being rotatably or pivotally mounted within the interior of the forward support arm 50. Rotation of the handle 72 has the effect of raising and lowering the pivotal connection of the front end of lever 62 relative to the support arm 50, which in turn lowers or raises the pivotal connection between the gas springs and the rear end of lever 62. The raised and lowered positions of the lever 62 are illustrated in FIG. 2, with the raised position being in solid lines and the lowered position being in broken lines. Changing the height of the connection between the gas springs and lever 62 varies the effective moment arm through which the springs are pushing so they exert more or less lifting force on the front support arm 50. This has the effect of floating the hose pickup nozzle higher above or closer to the ground. Gas springs require less operator manipulative force for hose movement than prior art leaf springs.

The support arms 50 and 40, as their names imply, support the hose 24 in the position of FIG. 1 so that the operator may manipulate the hose, as described hereinafter. The height of the pickup end of the hose above the surface being cleaned is controlled by the handle 72, easily accessible to the operator while in the seat 16, again as shown in FIG. 1.

Figure 5:
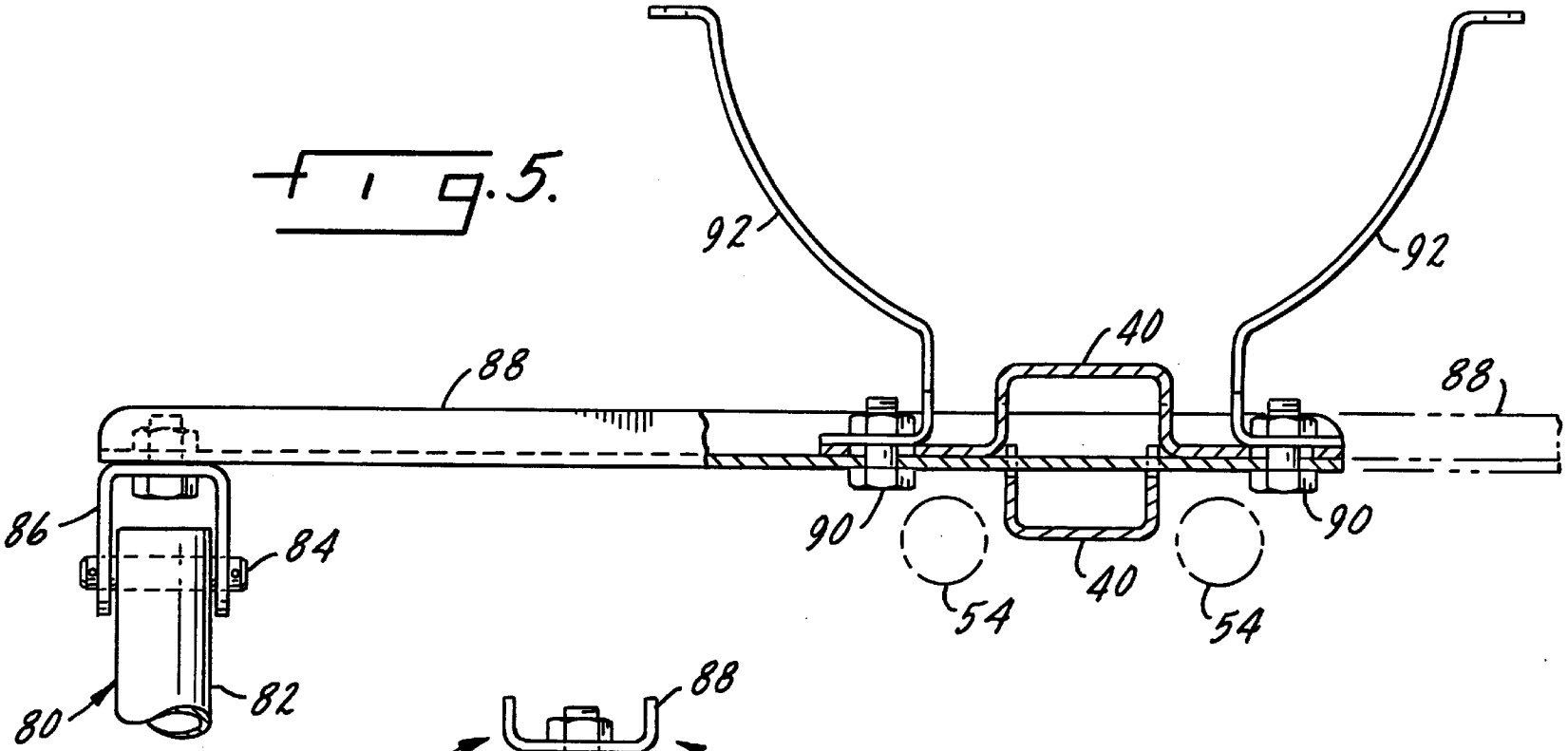
FIG. 5 is a section along plane 5—5 of FIG. 2.
Figure 6:
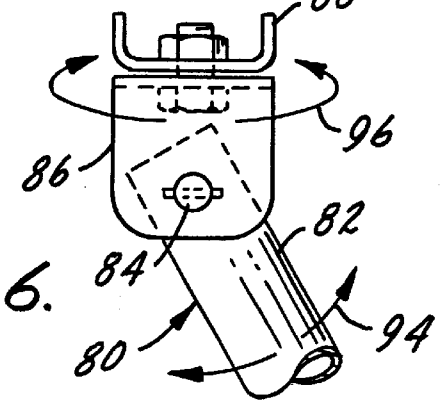
FIG. 6 is an enlarged view of the connection between the telescopic control rod and the support element of FIG. 5.

Movement of the hose 24 is controlled by a telescopic arm assembly 80, shown in FIG. 1, and illustrated in detail in FIGS. 5–10. It is comprised of upper tube 82, sleeve 100, handle 106 and fork 104. Focusing first on the upper mounting for the arm assembly, the top of the arm assembly 80, an upper tube 82, is pivotally mounted for movement about a horizontal axis on a pin 84 extending through opposite sides of a bracket 86. The bracket 86 is pivotally bolted to an anchor bracket 88, which in turn is bolted to the rear support arm 40 by bolts 90, particularly shown in. FIG. 5. The bolts 90 also secure hose supports 92 which extend upwardly and outwardly from opposite sides of the rear support arm 40. The anchor bracket 88 may be mounted to extend to either the left side or the right side of the hose support, depending upon the preference of the machine operator or depending upon whether more debris will be picked up on the left or right side of the machine. This provides an advantage to the operator in terms of the ease of use of the hose for picking up litter. As clearly shown in FIG. 6, the upper end 82 of the telescopic support rod is pivoted about a horizontal axis, as shown by arrows 94, and is pivotal about a vertical axis, as shown by arrows 96. Thus, the control for the operator to manipulate the hose is essentially universally movable about its upper support assembly.

The telescopic arm assembly 80 includes the upper tube 82, the end of which is mounted as described. The tube 82 extends within a sleeve 100, shown in FIG. 7, with these elements being telescopically movable to vary the length of the support assembly. At the lower end of assembly 80 there is a stub shaft 102 which also extends into and is pinned to the sleeve 100 at 98, with the stub shaft 102 being connected to and forming part of a fork 104, which is indirectly connected to and carries the lower end of the hose 24.

The handle for use by the operator in manipulating the hose is indicated generally at 106 and will be located along sleeve 100 by two collet-type clamp collars indicated at 108 and 110 located at opposite ends of the handle 106. The handle 106 may be moved along sleeve 100 by loosening, moving and then tightening the collars 108 and 110. The handle 106 includes a tubular portion 112 and three separate hand gripping areas which are all joined together. There is a vertical hand gripping area 114 and left and right hand gripping areas 116 and 118. The hand gripping areas are tubular, as indicated by the cross section of FIG. 9. The operator may grip either the left side, the right side or the vertical portion of the handle which provides both ease in controlling movement of the hose and substantially lessens fatigue on the part of the operator by allowing use of either hand and shifting of the hand to different positions when manipulating the hose.

Of particular advantage in the handle shown and described herein is that it fits loosely over the telescopic tube assembly 80 and swivels freely relative thereto. Thus, when the operator holds the handle to move the hose around, it always stays aligned with the operator's body or arm, regardless of how the tube is swung about.

Figures 7, 8, 9, 10:
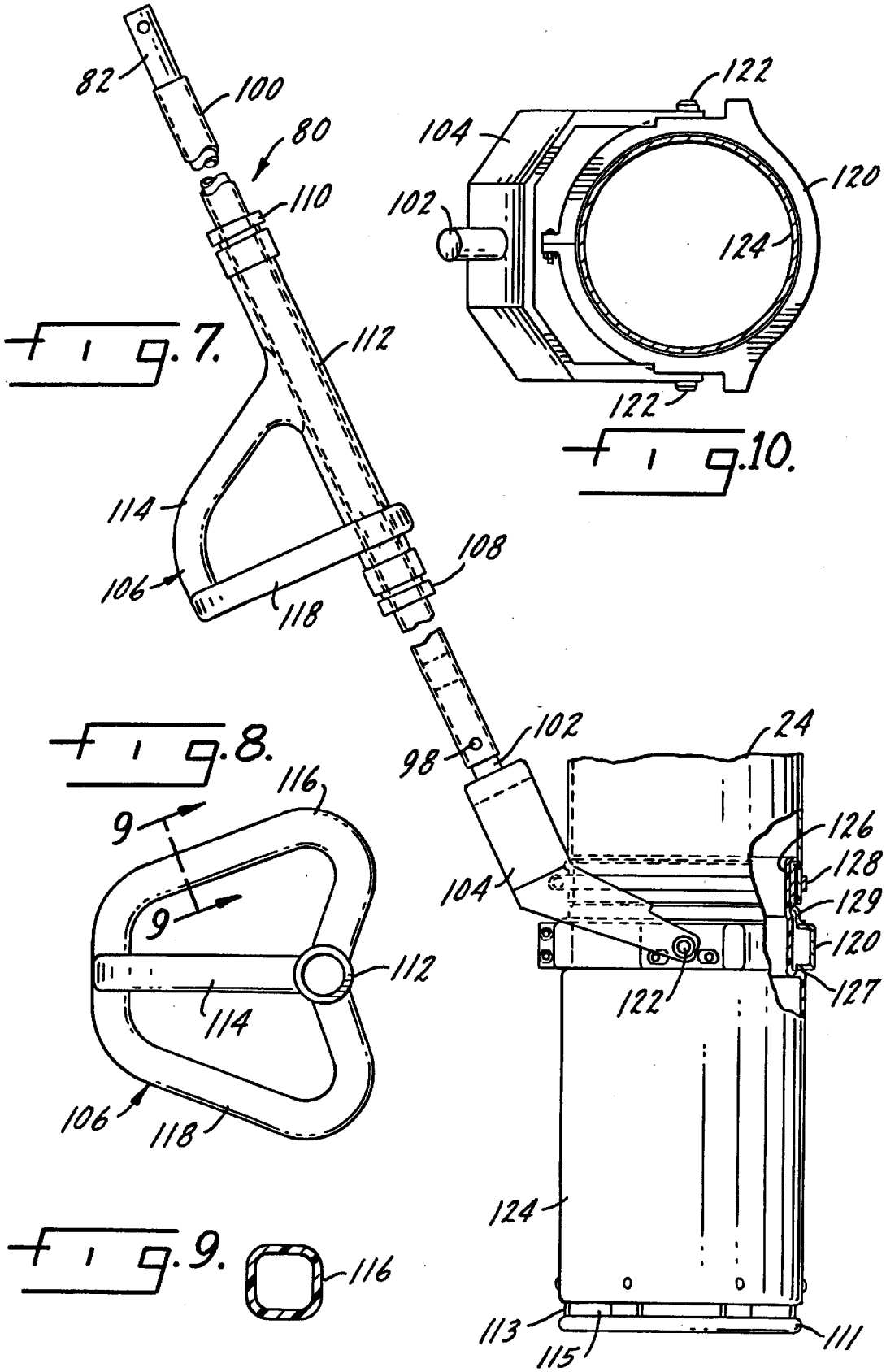
FIG. 7 is an enlarged side view of the operator control assembly and its connection to the hose.
FIG. 8 is a top view of the operator handle.
FIG. 9 is a section along plane 9—9 of FIG. 8.
FIG. 10 is a top view showing the connection between the hose support ring and the hose yoke.

The fork 104 which forms the lower connection point for the telescopic tube assembly 80 is pivotally connected to a ring 120 as particularly shown in FIGS. 7 and 10. There are stub pivot shafts 122 attached to and extending outwardly from the ring with the fork 104 being pivotally attached thereto.

The ring 120 loosely surrounds a pickup nozzle 124, as shown in the partial section of FIG. 7, with the nozzle 124 extending inside of the hose 24 as at 126. A hose clamp 128 secures the lower end of hose 24 to the upper end 126 of the nozzle, again as particularly shown in FIG. 7. Ring 120 is loosely retained between a shoulder 127 formed in nozzle 124 and a flanged collar 129 fitted inside the end of hose 124. This type of pivotal connection between the hose and its control eliminates twisting of the hose, which has considerable torsional stiffness, and thus allows the operator to manipulate or control the hose with substantially less fatigue than prior art devices of a similar type. The nozzle 124 has a guard ring 111 spaced from its open end by mounting brackets 113, which provides an air gap 115. The air gap 115 allows the operator to drag the hose along a surface to be cleaned without vacuum causing it to stick to the ground. The ring 111 also dislodges flattened-out wet debris.

Figure 11:
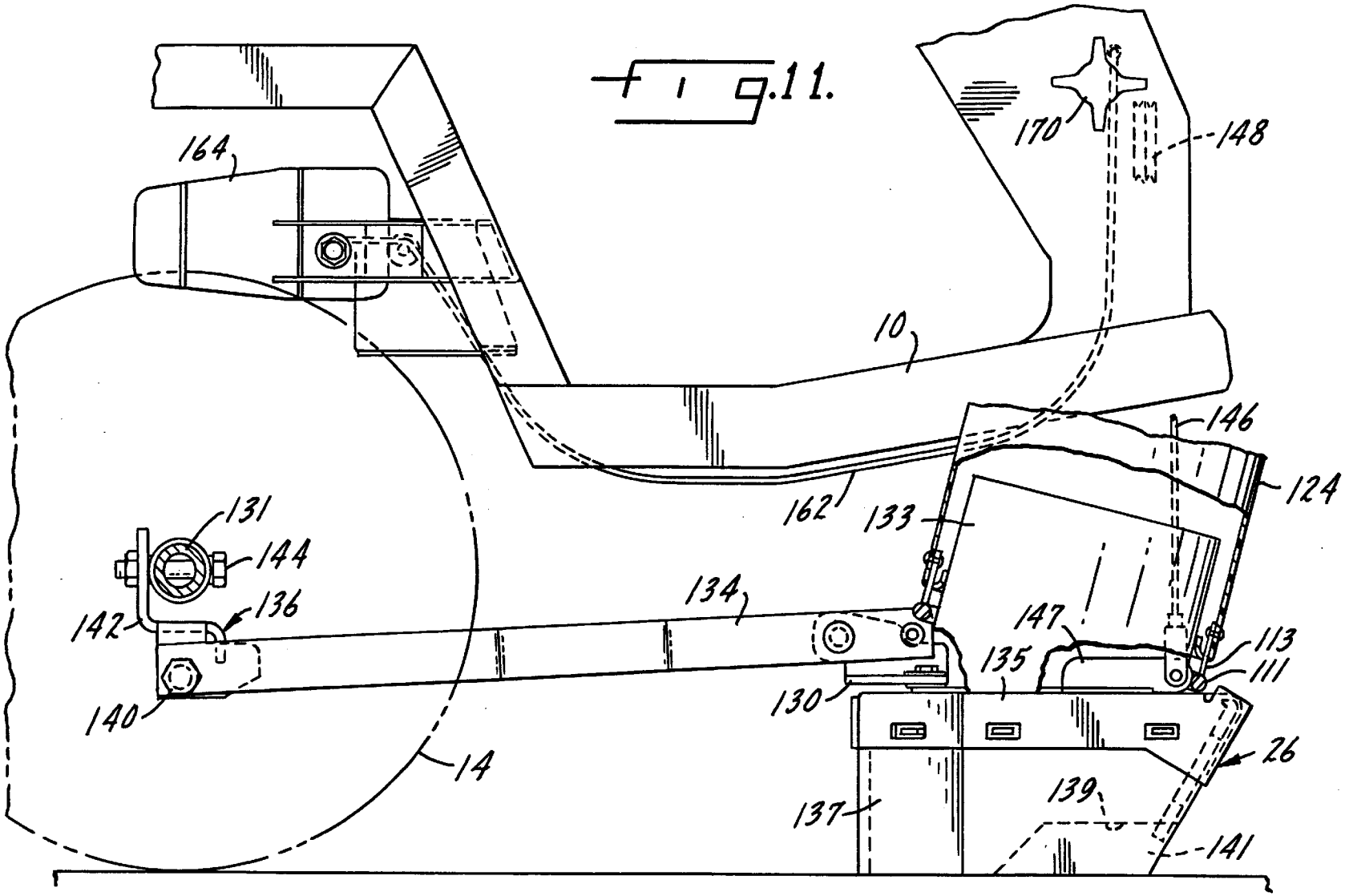
FIG. 11 is a partial enlarged side view of the vehicle showing the pickup head and its connection to the vehicle frame and front axle.
Figure 12:
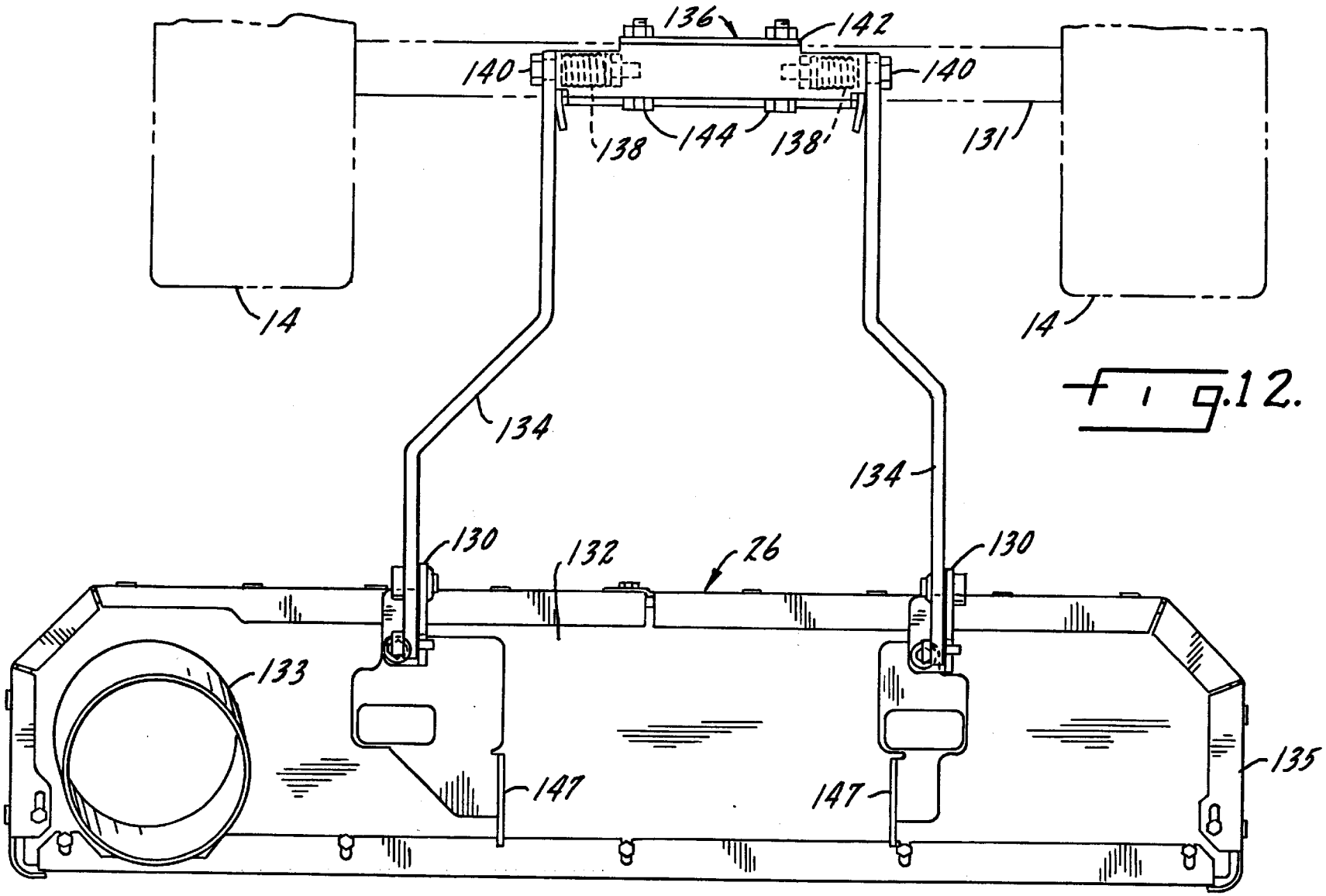
FIG. 12 is a top view of the pickup head and its connection to the vehicle front axle.
Figure 13:
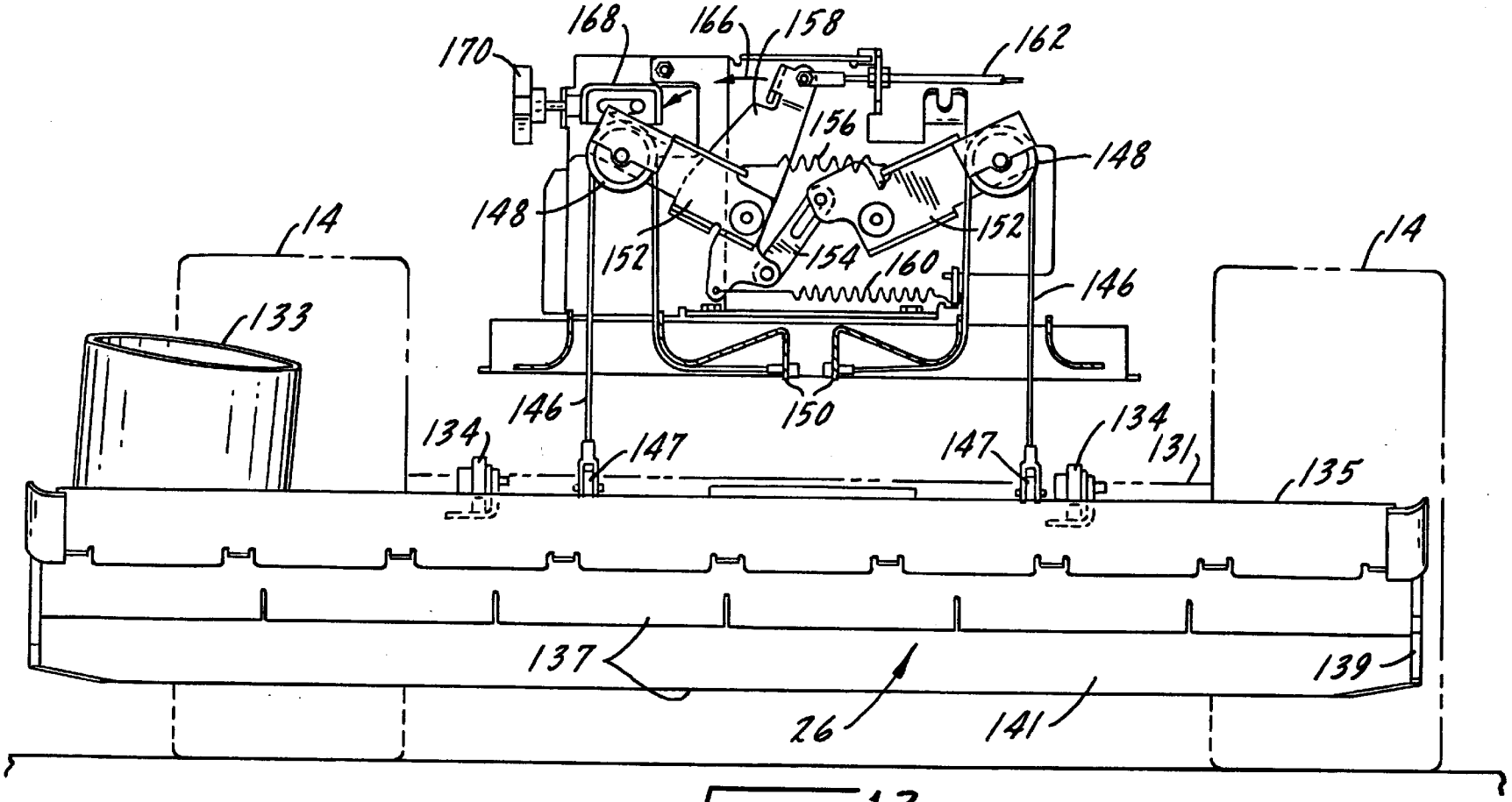
FIG. 13 is a front view of the pickup head and its connection to the vehicle frame.
Figure 17:
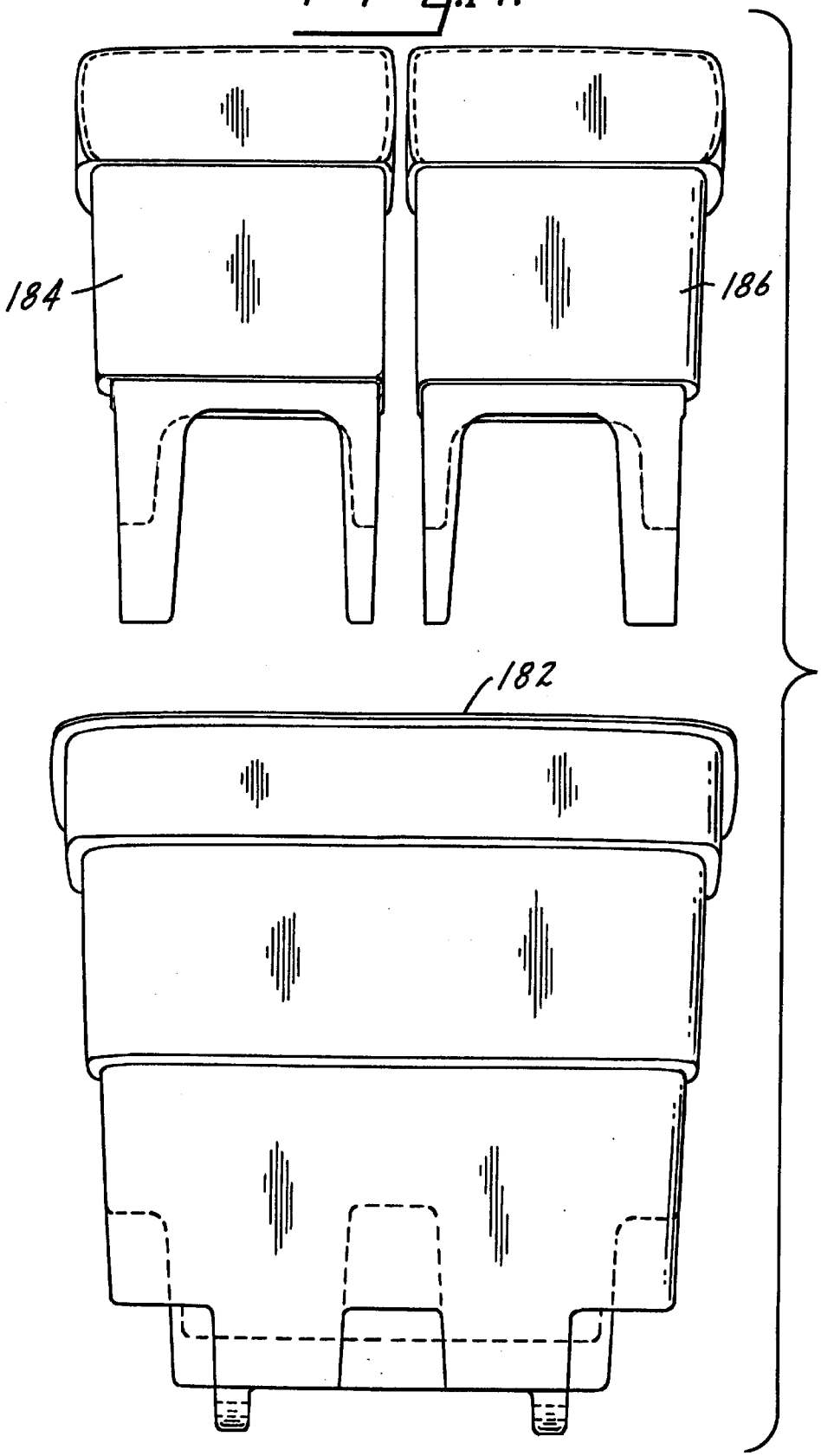
FIG. 17 is an exploded view illustrating the trash collection canister and the rigid liners used therein.

FIGS. 11, 12 and 13 illustrate the mounting of the pickup head 26 on the front axle 131. Brackets 130 are mounted to the top 132 of the pickup head and rearwardly extending arms 134 are pivotally mounted to each of the brackets 130. The arms 134, as particularly shown in FIGS. 11 and 12, are pivotally attached to a support assembly 136 which includes a pair of torsion springs 138 mounted on bolts 140 to permit yielding movement of the pickup head 26. The assembly 136 includes an upwardly extending flange 142 which will be attached by bolts 144 to the axle 131 of the front wheels 14. Thus, the pickup head 26 may be responsive to contact with large debris in that it has up, down and twisting yielding movement due to the presence of the torsion springs 138.

At one side of the top 132 of the pickup head 26 there is a stub tube 133 which will support the hose 24 on top of the pickup head as illustrated in FIG. 1. In this position, the hose is not used as an independent litter pickup device, but rather provides the suction to the pickup head so that it may sweep a wide area for litter. The pickup head has a peripheral skirt, as is customary, with the skirt comprising an upper retainer 135 and a depending flexible for example rubber skirt 137. The skirt 137 is peripheral, but has an opening on the left side, that being the side away from the stub tube 133, with the opening being indicated at 139. The skirt is also open across the front of the machine, as at 141, so that it may pass over debris to be sucked up by the pickup head. The advantage in having the opening 139 at the side of the pickup head opposite the point of suction, that being the stub tube 133, is that the air flow will be completely across the front of the pickup head which may be either 40" or as much as 48" in width. By drawing air across the full width of the pickup head a high air velocity is obtained, and the debris which is accessible at the front of the pickup head will be moved across its width into the stub tube 133, through the hose and into the debris containers. This provides a more efficient pattern for movement of picked up debris and litter. Also, by positioning the vacuum connection to one side of the pickup head, the area of maximum suction power may be located along a curb or fence where debris is more heavily concentrated.

The pickup head can be raised or lowered depending upon whether it is to be used as the means for picking up litter or whether it is to be unused and litter is to be picked up by the hose 24. A pair of cables 146, as shown in FIG. 13, are attached to the top 132 of the pickup head 126 with brackets 147, with the cables each extending around a pulley 148 and being dead-ended in a bracket 150. The pulleys 148 may be raised and lowered, which moves the pickup head away from or toward the surface to be cleaned. Each pulley is mounted on a pivotal arm 152 with the arms being connected by a lost motion link 154. The two arms 152 are connected together by a spring 156 and there is an actuating lever 158 which is connected to the left arm 152 and to link 154 and has, at its lower end, a spring 160 which is fixed to the vehicle frame. The upper end of actuating lever 158 is connected by a cable 162 to an actuator 164 shown in FIG. 11. The actuator is mounted on the vehicle frame and will either pull in or let out the cable 162, which will have the end result of raising or lowering the pulleys 148, which in turn raises or lowers the pickup head. The movement of the lever 158 is illustrated in FIG. 13 by the arrows 166 with such movement being effective to raise or lower the pulleys through the combination of the arms 152, the springs 160 and 156, the lost motion link 154 and a stop 168, the position of which is controlled by a manual control knob 170. By using this knob, the operator may control the height above the ground to which the pickup head can be raised or lowered. The actual raising and lowering of the pickup head is done by the actuator 164 which also will be controlled by the operator from one of the dashboard mounted controls.

FIGS. 14 through 22 illustrate the trash containers, the cover over them, the vacuum system and the mechanism which permits variable tilting of the trash containers for convenient disposal of the collected debris by the machine operator. In FIG. 14, the vacuum fan is illustrated generally at 32 and is located within the cover 30 and the vacuum fan is driven by a motor 172. Air is exhausted to atmosphere through an outlet 173. The hose inlet for the cover 30 where suction hose 24 connects is shown at 174 and there is a further inlet 176 which will be used with a wand pickup, the wand being illustrated generally at 178 in FIG. 1. The wand will be used when the machine operator dismounts and moves to pick up debris from an area that is not accessible while riding on or driving the machine.

The hose inlet 174 will direct debris into a plenum which is defmed within the cover in the area 180 and located directly above a debris canister 182. The debris canister 182, shown in FIG. 17, will contain two side-by-side debris containers, such as plastic. bags, which will be maintained in an open position for collection of debris by identical rigid inserts 184 and 186 shown in FIG. 17. The inserts, which may have open bottoms, will be placed inside of the plastic bags or other suitable debris containers and then the plastic bags will be placed side-by-side within the debris canister 182. The debris containers may each be on the order of 50 gals. in volume and will be seated side-by-side within the debris canister so that both will be filled as debris is sucked up by either the hose 24 or the vacuum head 26 or the wand 178. Thus, the present invention provides essentially double the normal capacity of prior art machines of this type.

In order to insure that the debris containers are relatively evenly filled, there is a deflector plate 188, shown in FIGS. 15 and 16, which is mounted longitudinally in the lateral center and near the top of the debris canister and which has deflecting flanges 190 which will cause the debris which is sucked in generally centrally of the debris canister to be directed to both of the debris containers. The plate 188 extends longitudinally completely across the top of the debris canister so that it will deflect the incoming litter laterally into the two plastic bags.

The cover 30 is attached by a hinge 192 to a hinge mount 194 which permits the cover to be raised up, as shown by dotted line 30A, so that the debris canister may be pivoted rearwardly as indicated by the two dotted line positions 208 and 210 in FIG. 14. The hinge mount .194 is fixed on the top of a post 196 and there is a gas spring 198 mounted to the hinge 192 and to the post 196 with the gas spring balancing the cover 30 and the vacuum fan when the cover is lifted. There is a cable 200 which is fastened to the debris canister at 202, as shown in FIG. 14 and to the post 196 at its opposite end, which cable will limit the pivotal movement of the debris canister as it is moved between the closed position of FIG. 14 and the lower broken line tilted position 210 of this same figure. The canister pivotal mounting is indicated at 204 and the canister will rest upon a front mount 206 when it is in the closed position shown in FIG. 14.

The debris canister may be moved first to a partially open position as shown by the broken lines indicated at 208 in FIG. 14 and fmally to a full open position shown by the broken lines 210 in FIG. 14. In the first position, the trash bags may be tied at the top and at the second position the trash bags may be removed. The second position 210 provides for removal of the trash bags with less vertical lifting than if they were in the position 208, which assists the operator and provides trash removal with much less effort.

FIGS. 18 through 22 illustrate the mechanism for controlling movement of the debris canister through the various positions described above. The bottom of the canister has a stop 208 bolted thereto with the stop having a stiffening gusset 210. A portion of the vehicle frame is indicated at 212 and the pivot 204 will be attached to this portion of the frame. The frame mounts a bracket 214 which carries two forward flanges 216 pivotally mounting a block 218. Bracket 214 also has a floor 215 which serves as a motion stop for block 218, as shown in FIGS. 19 and 21. The block 218 has a forwardly curved nose 220 connected by two springs 222 to the bracket 214. The springs 222 urge the block to rotate in a counter clockwise direction about its pivot point 223.

FIG. 19 illustrates the closed position of the debris container with the block 218 being held firmly against bracket floor 215 by springs 222. FIG. 21 illustrates the position 208 of the debris canister. The debris canister has been moved rearwardly about its pivot 204 until the curved area 224 of the block 218 has encircled a stop pin 226 carried near the bottom of stop 208. The debris canister will be held in this position because the springs 222 hold the block in the described position against bracket floor 215.

When it is desired to move the debris canister to the fully tilted position illustrated at 210, a back and down movement by the machine operator on the debris canister is effective to push the block 218 up, fully releasing the debris canister from the FIG. 21 position and permitting its full movement to the FIG. 22 position. It is held in this position by the cable 200 and can move no further. Springs 222 go over center and hold block 218 against bracket 214. When it is desired to move the debris hopper back to its upright position, pin 210 will rotate downward about pivot 204, and will strike the tail end 219 of block 218, causing it to rotate back to the position of FIG. 19.

Thus, the debris canister has several advantages. It has double the normal litter capacity since it has side-by-side litter containers, each of which may be about 50 gals. in capacity. Further, it has more than one open position facilitating removal of the debris containers once the bags have been tied at their tops and permitting such removal without strain on the operator's back. Rather than lifting the bags directly up, they may be removed by sliding them rearwardly.

Whereas the preferred form of the invention has been shown and described herein, it should be realized that there may be many modifications, substitutions and alterations thereto.

The embodiments of the invention in which an exclusive property or privilege is claimed are defined as follows:

1. A vacuum trash collection vehicle comprising a debris container on a vehicle, a source of vacuum on the vehicle, a hose connected at one end to the debris container and having the source of vacuum applied thereto, said hose being open at its other end to form a collection nozzle, a boom for supporting said hose during use as a debris collection device, a vacuum pickup head carried by said vehicle, means for raising and lowering said vacuum pickup head away from and toward a surface to be cleaned, an opening in said vacuum pickup head of a size and shape to be connected to said collection nozzle, driver accessible control means for moving said hose and boom to utilize said collection nozzle as the debris collection device, the connection of said collection nozzle to said pickup head opening providing vacuum to said pickup head whereby said pickup head functions as a debris collection device.

2. The vacuum trash collection vehicle of claim 1 including a driver's seat and controls for the driver on the vehicle for operating it, said hose and boom extending above the driver's seat.

3. The vacuum trash collection vehicle of claim 1 wherein said pickup head extends laterally across the front of the vehicle, said pickup head opening being on an upper portion of said pickup head and generally adjacent one end thereof.

4. The vacuum trash collection vehicle of claim 3 wherein said opening in the pickup head is in the form of a short tube extending upwardly from said pickup head, with said short tube and collection nozzle forming a vacuum-tight connection therebetween.

5. The vacuum trash collection vehicle of claim 3 wherein said pickup head has a peripheral skirt extending thereabout, an opening in the peripheral skirt opposite the end of the pickup head having the opening, whereby air flow from outside of said pickup head extends laterally across said pickup head as it flows from the opening in the peripheral skirt, toward the opening in the upper portion of the pickup head.

6. The vacuum trash collection vehicle of claim 1 including power means on said vehicle, controllable by a driver, for operating said means for raising and lowering said pickup head.

7. The vacuum trash collection vehicle of claim 1 wherein said driver accessible control means for moving said hose and boom includes an elongated telescopic control assembly, said control assembly having a handle thereon for use by said driver.

8. The vacuum trash collection vehicle of claim 1 further comprising driver accessible pickup head control means for actuating said means for raising and lowering said vacuum pickup head away from and toward a surface to be cleaned.

9. The vacuum trash collection vehicle of claim 1 wherein said opening in the pickup head is in the form of a short tube extending upwardly from said pickup head, with said short tube and collection nozzle forming a vacuum-tight connection therebetween.

10. The vacuum trash collection vehicle of claim 1 further characterized in that the collection nozzle is connectable to and detachable from said opening in said vacuum pickup head by manipulation of the driver accessible control means.

11. A vacuum trash collection vehicle comprising a debris container on a vehicle, a source of vacuum on the vehicle, a hose connected at one end to the debris container and having the source of vacuum applied thereto said hose being open at its other end to form a collection nozzle, a boom for supporting said hose during use as a debris collection device, a vacuum pickup head carried by said vehicle, an opening in said vacuum pickup head of a size and shape to be connected to said collection nozzle, driver accessible control means for moving said hose and boom to utilize said collection nozzle as the debris collection device, the collection nozzle being connectable to and detachable from said opening in said vacuum pickup head by manipulation of the driver accessible control means, the connection of said collection nozzle to said pickup head opening providing vacuum to said pickup head whereby said pickup head functions as a debris collection device.

12. The vacuum trash collection vehicle of claim 11 including a driver's seat and controls for the driver on the vehicle for operating it, said hose and supporting boom extending above the driver's seat.

13. The vacuum trash collection vehicle of claim 11 wherein said pickup head extends laterally across the front of the vehicle, said pickup head opening being on an upper portion of said pickup head and generally adjacent one end thereof.

14. The vacuum trash collection vehicle of claim 13 wherein said opening in the pickup head is in the form of a short tube extending upwardly from said pickup head, with said short tube and nozzle forming a vacuum-tight connection therebetween.

15. The vacuum trash collection vehicle of claim 13 wherein said pickup head has a peripheral skirt extending thereabout, an opening in the pickup head skirt opposite the end of the pickup head having the opening, whereby air flow from outside of said pickup head extends laterally across said pickup head as it flows from the opening in the peripheral skirt, toward the opening in an upper portion of the pickup head.

16. The vacuum trash collection vehicle of claim 11 further comprising means for raising and lowering said vacuum pickup head away from and toward a surface to be cleaned.

17. The vacuum trash collection vehicle of claim 16 including power means on said vehicle, controllable by a driver, for operating said means for raising and lowering said pickup head.

18. The vacuum trash collection vehicle of claim 11 wherein said driver accessible control means for moving said hose and boom includes an elongated telescopic control assembly, said control assembly having a handle thereon for use by said operator.

19. A vacuum trash collection vehicle comprising a debris container on a vehicle, a source of vacuum on the vehicle, a hose connected at one end to the debris container and having the source of vacuum applied thereto, said hose being open at its other end to form a collection nozzle, a boom for supporting said hose during use as a debris collection device, a vacuum pickup head carried by said vehicle and extending laterally across the front of the vehicle, an opening in said vacuum pickup head of a size and shape to be connected to said collection nozzle, said pickup head opening being on an upper portion of said pickup head and generally adjacent one end thereof, driver accessible control means for moving said hose and boom to utilize said collection nozzle as the debris collection device, the connection of said collection nozzle to said pickup head opening providing vacuum to said pickup head whereby said pickup head functions as a debris collection device.

20. The vacuum trash collection vehicle of claim 19 further characterized in that the collection nozzle is connectable to and detachable from said opening in said vacuum pickup head by manipulation of the driver accessible control means.

21. The vacuum trash collection vehicle of claim 19 including a driver's seat and controls for the driver on the vehicle for operating it, said hose and supporting boom extending above the driver's seat.

22. The vacuum trash collection vehicle of claim 19 wherein said opening in the pickup head is in the form of a short tube extending upwardly from said pickup head, with said short tube and nozzle forming a vacuum-tight connection therebetween.

23. The vacuum trash collection vehicle of claim 22 wherein said pickup head has a peripheral skirt extending thereabout, an opening in the pickup head skirt opposite the end of the pickup head having the opening, whereby air flow from outside of said pickup head extends laterally across said pickup head as it flows from the opening in the peripheral skirt, toward the opening in an upper portion of the pickup head.

24. The vacuum trash collection vehicle of claim 19 further comprising means for raising and lowering said vacuum pickup head away from and toward a surface to be cleaned.

25. The vacuum trash collection vehicle of claim 24 including power means on said vehicle, controllable by a driver, for operating said means for raising and lowering said pickup head.

26. The vacuum trash collection vehicle of claim 19 wherein said driver accessible control means for moving said hose and boom includes an elongated telescopic control assembly, said control assembly having a handle thereon for use bv said operator.

* * * * *